United States Patent [19]

Örje

[11] Patent Number: 4,704,771

[45] Date of Patent: Nov. 10, 1987

[54] LOCK FOR SAFETY BELTS AND LOCK TONGUE THEREOF

[75] Inventor: Christer H. Örje, Bad Schwartau, Fed. Rep. of Germany

[73] Assignee: Broderna Holmbergs Fabriks AB, Anderstorp, Sweden

[21] Appl. No.: 738,674

[22] Filed: May 28, 1985

[51] Int. Cl.[4] ..... A44B 11/26

[52] U.S. Cl. ..... 24/574; 24/633

[58] Field of Search ..... 297/467, 484, 464; 24/573, 574, 605, 633, 637, 638, 641; 280/801, 808

[56] References Cited

U.S. PATENT DOCUMENTS

| | | | |
|---|---|---|---|
| 626,273 | 6/1899 | Durnell | 24/573 |
| 3,520,034 | 7/1970 | Glauser et al. | 24/574 |
| 3,534,448 | 10/1970 | Hughes | 24/574 |
| 3,542,426 | 11/1970 | Radke | 24/573 |
| 3,774,268 | 11/1973 | Holmberg . | |
| 3,834,758 | 9/1974 | Soule | 24/573 X |
| 3,845,524 | 11/1974 | Hull et al. | 24/573 |
| 3,921,262 | 11/1975 | Tanaka . | |
| 4,062,091 | 12/1977 | Holmberg . | |
| 4,540,218 | 9/1985 | Thomas | 297/467 |

FOREIGN PATENT DOCUMENTS

| | | | |
|---|---|---|---|
| 137374 | 4/1985 | European Pat. Off. | 24/573 |

*Primary Examiner*—Kenneth J. Dorner
*Assistant Examiner*—James R. Brittain
*Attorney, Agent, or Firm*—Merchant, Gould, Smith, Edell, Welter & Schmidt

[57] ABSTRACT

In a safety buckle having a frame with a latch mechanism and a tongue plate which is insertable into the frame to be latched therein, said tongue plate forms a pin for a strap fitting to be passed thereonto and thus be connected with the buckle when the tongue plate is latched in the frame.

2 Claims, 7 Drawing Figures

LOCK FOR SAFETY BELTS AND LOCK TONGUE THEREOF

This invention relates to a safety buckle having two parts that can be locked to each other, and particularly to a safety buckle of the type which is used in vehicle safety seat belts for children, wherein a first hip strap and a first shoulder strap are connected to one part of the buckle, and a second hip strap and a second shoulder strap are connected to the other part of the buckle, said straps being interconnected by the buckle parts being latchingly engaged. In many cases the safety belt includes also a crotch strap which is separately hooked onto one part of the buckle.

The safety buckle of the invention comprises a frame to be connected to at least one first strap and forming an insert opening, a latch member pivotally mounted to the frame, and a tongue plate to be connected to at least one second strap and insertable into said opening, said latch member being spring biased to a position of engagement with said tongue plate when inserted through said opening and being accessible for finger pressure to be operated to a disengaged position for releasing the tongue plate.

Safety buckles of this type are disclosed in U.S. Pat. Nos. 3,774,268, 3,921,262 and 4,062,091.

In the safety buckle disclosed in U.S. Pat. No. 3,921,262 a shoulder strap is connected to the tongue plate by a fitting attached to the shoulder strap being hooked into a key-hole in the tongue plate. A connection of this type does not, however, give the safety that is called for today.

The purpose of the invention is to provide a safety buckle of the type referred to above, which provides a safe and reliable interconnection between hip and shoulder straps and a supplementary crotch strap and which is easy to use.

Additional purposes and advantages of the invention will be set forth in the description which follows.

For the foregoing purpose the invention provides in a safety buckle of the type referred to the improvement comprising a pin formed by said tongue plate and projecting in the direction of insertion of the tongue plate to be received, at the free end thereof, by said insert opening, and a fitting to be connected to a third strap and forming a socket to be passed onto the pin. Thus, when the first and second straps are to be interconnected the fitting is passed onto the pin of the tongue plate at the socket portion thereof and then, when the tongue plate is inserted into the insert opening of the frame to be locked therein by the latch member with the first and second straps connected to each other by means of the buckle, the third strap is at the same time connected to the buckle.

Figure 3:
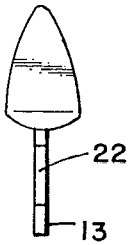
Figure 4:
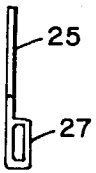
Figure 5:
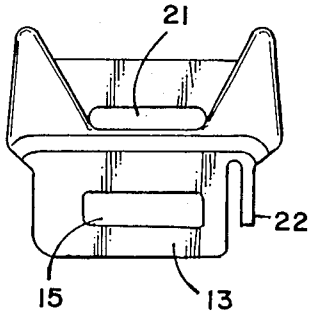
Figure 2:
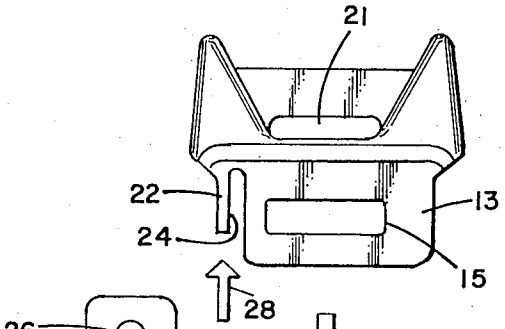
Figure 2:
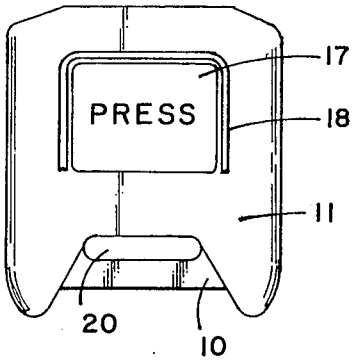
Figure 1:
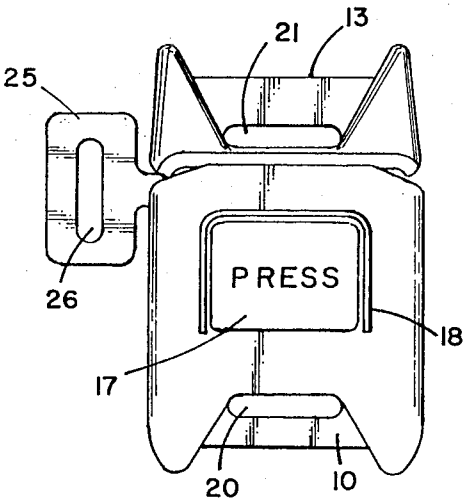
Figure 6:
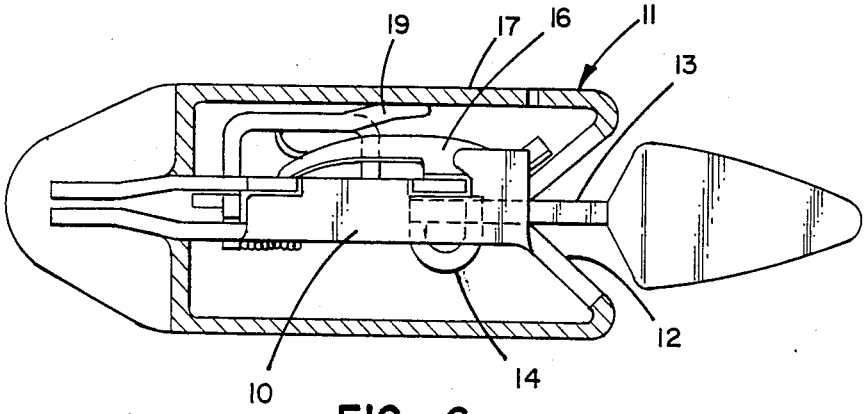
Figure 7:
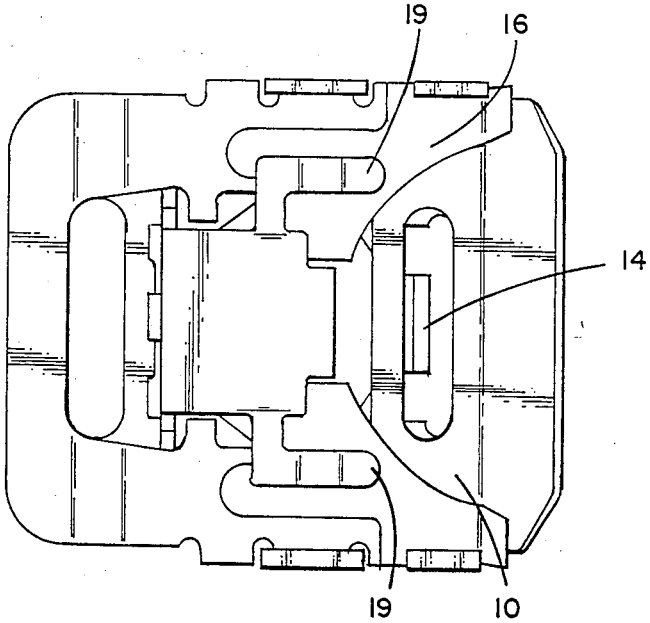

An illustrative embodiment of the invention will be described below, reference being made to the accompanying drawings in which FIG. 1 is a plan view of the safety buckle of the invention with the tongue plate inserted therein, FIG. 2 is an exploded view of the safety belt buckle, FIG. 3 is a side view of the tongue plate as seen from the left in FIG. 2, FIG. 4 is a side view of a fitting forming part of the safety buckle of the invention, FIG. 5 is a plan view of the tongue plate as seen from the side opposite to that shown in FIG. 2, FIG. 6 is an enlarged longitudinal sectional view of the buckle with the tongue plate inserted therein, and FIG. 7 is an enlarged plan view of the buckle without the tongue plate and without the enclosing non-load bearing housing thereof.

The safety buckle disclosed in the drawings comprises a frame 10 constructed of steel sheet and enclosed by a non-load bearing plastic housing 11. The frame forms an insert opening with a flared entrance portion 12 for a tongue plate 13. The frame mounts a latch mechanism which can be of any known construction for example of one of the constructions disclosed in the U.S. patents referred to above. It is shown herein to include a pivoted latch member 14 having an engaged position shown in FIG. 6 in which the latch member engages an opening 15 in the tongue plate when inserted into the frame, in order to retain the tongue plate therein. The latch member can be operated to an disengaged position against the bias of a spring plate 16 by finger pressure against a rectangular flap 17 formed by the casing and separated therefrom by a slot 18 extending along three sides of the flap, the pressure against the flap being transmitted to the latch member at two arms 19 formed by said member. The latch mechanism should include also an ejector for the tongue plate although the details thereof are not shown in the drawings since the provision of an ejector is well known in the art.

The frame forms a slot 20 for the attachment of a first hip strap and a first shoulder strap, and the tongue plate forms a slot 21 for the attachment of a second hip strap and a second shoulder strap.

The tongue plate 11 forms a pin 22 which extends in the direction of insertion of the tongue plate indicated by an arrow 23 in FIG. 2. The pin is located at one side edge of the tongue plate as an integral part thereof and is separated from the rest of the tongue plate by a slot 24. A metal sheet fitting 25 forms a slot 26 for the attachment of a crotch strap, and also forms a socket 27 at which the fitting can be passed onto the pin as indicated by the arrow 28 in FIG. 2.

When the frame 10, the tongue plate 13 and the fitting 25 are attached to the associated straps of the safety belt and the elements of the safety buckle are separated as shown in FIG. 2, the safety belt is put into use by first passing the socket 27 of the fitting 25 onto the pin 22 and then inserting the tongue plate 13 into the frame 10 until the tongue plate is latched therein. The pin 22 should be of sufficient length so as to be received at the free end thereof in the opening of the frame, and thus, when the tongue plate is in the latched position in the frame, the fitting 25 is located between the housing of the frame and the tongue plate as is shown in FIG. 1. In this position the fitting is safely latched to the buckle.

As will be seen, the safety buckle of the invention provides simple and reliable means for interconnecting the several straps by one latch mechanism.

I claim:

1. A safety buckle comprising a frame including spaced sidewalls to be connected to at least one first strap and forming a slot-like insert opening having a flared entrance portion defined by two opposite walls extending along the major dimension of the slot-like insert opening between said spaced sidewalls and converging towards the insert opening, said entrance portion including a recess in each sidewall at the ends of said converging walls, said recesses open in a direction opposite the direction of insertion of said tongue, a latch member pivotally mounted to the frame, a tongue plate to be connected to at least one second strap and insertable into said opening through said flared entrance portion, spring means biasing said latch member to a position of engagement with said tongue plate when inserted in said opening, a spring plate accessible for finger pressure for operating the latch member against the spring bias to a disengaged position to release the tongue plate from the latch member, a pin formed as a part of said tongue plate at one side edge thereof and projecting towards a free end thereof in the direction of insertion of the tongue plate, and a fitting to be connected to a third strap and forming a socket to be passed onto said pin from the free end thereof, said flared entrance portion receiving the fitting when passed onto the pin, the fitting projecting laterally beyond the sidewall through one recess of the flared entrance portion.

2. The improvement as claimed in claim 1 wherein the pin is an integral portion of the tongue plate separated from the rest of the tongue plate by a slot formed therein.

* * * * *